US005427084A

United States Patent [19]

Arnold et al.

[11] Patent Number: 5,427,084

[45] Date of Patent: Jun. 27, 1995

[54] WATER BALLOON TOSS SLING

[76] Inventors: Phillip E. Arnold, 1624 Cherokee, Great Bend, Kans. 67530; David M. Arnold, 2845 Washington, Wichita, Kans. 67216

[21] Appl. No.: 131,783

[22] Filed: Oct. 4, 1993

[51] Int. Cl.[6] ..... F41B 3/00

[52] U.S. Cl. ..... 124/5; 124/4

[58] Field of Search ..... 124/4, 5, 17, 20.1; 294/152, 149, 157; 224/217, 218, 219, 220, 222, 250; 473/59; 273/323, 324, 325, 326

[56] References Cited

U.S. PATENT DOCUMENTS

| | | | |
|---|---|---|---|
| 907,012 | 12/1908 | Day | 224/217 |
| 1,199,330 | 9/1916 | Adams . | |
| 1,419,682 | 6/1922 | Miles . | |
| 1,776,435 | 9/1930 | Isbell . | |
| 1,866,158 | 7/1932 | Goodwin | 124/5 |
| 2,311,160 | 2/1943 | Dobbelaar | 124/5 |
| 2,644,441 | 7/1953 | Simko . | |
| 4,131,102 | 12/1978 | Polly, Jr. . | |
| 4,232,648 | 11/1980 | Brown . | |
| 4,240,396 | 12/1980 | Randoll . | |
| 4,305,584 | 12/1981 | Leehan . | |
| 4,909,518 | 3/1990 | Erlandson et al. . | |
| 4,922,884 | 5/1990 | Ford . | |
| 5,190,021 | 3/1993 | Hull et al. . | |

FOREIGN PATENT DOCUMENTS

| | | | |
|---|---|---|---|
| 64794 | 12/1955 | France | 273/323 |
| 1283972 | 1/1962 | France | 273/323 |
| 433407 | 8/1926 | Germany | 273/324 |
| 830164 | 3/1960 | United Kingdom | 273/326 |

*Primary Examiner*—Randolph A. Reese
*Assistant Examiner*—Anthony Knight
*Attorney, Agent, or Firm*—John R. Flanagan

[57] ABSTRACT

A water balloon toss sling includes a pouch having a substantially triangular-shaped shallow cup-like configuration adapted for seating a water-filled balloon, a first length of cord attached at a pair of opposite ends along one side of the pouch and being adapted for placement over outwardly extending fingers of a person's hand, and a second length of cord attached at one end to an opposite end of the pouch and being formed into a loop at the opposite end of the cord for encircling a wrist of a person such that the pouch is suspendable below the person's hand, permitting rotational movement for tossing a water balloon from the sling. The pouch has a pair of spaced first and second corners and a third corner being equidistantly spaced from the first and second corners. The first length of cord is attached at its opposite ends to the first and second corners of the pouch. The second length of cord is attached at one end to the third corner of the pouch.

8 Claims, 1 Drawing Sheet

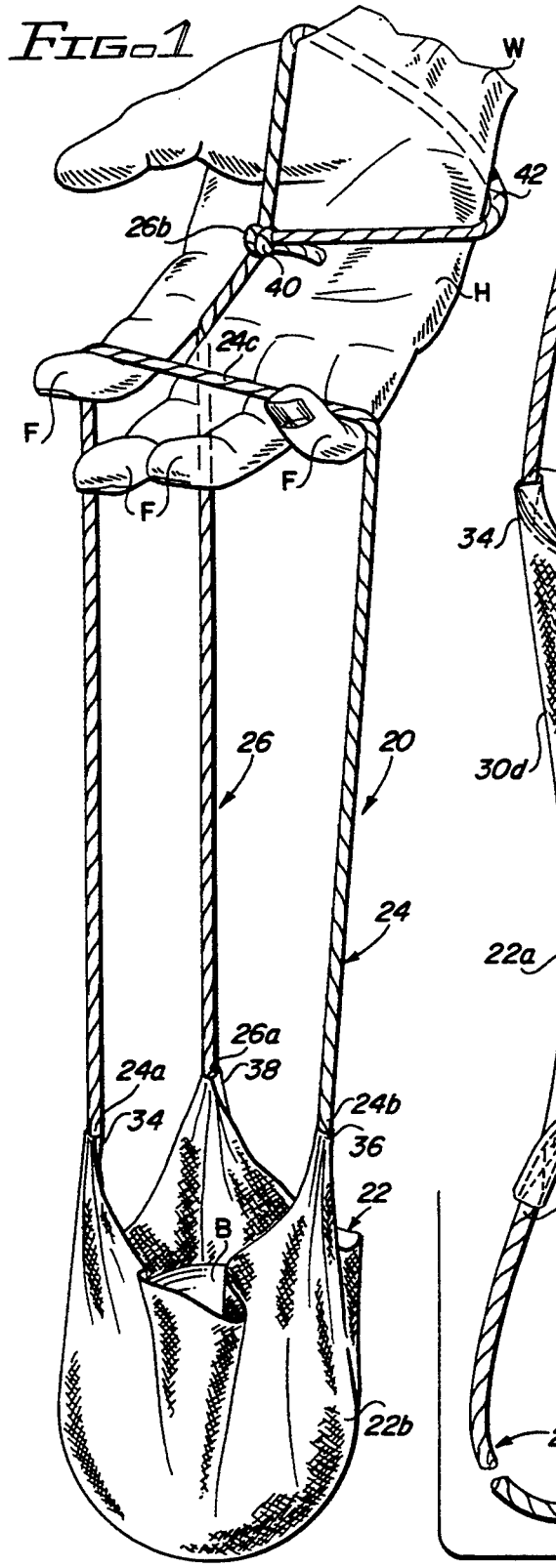
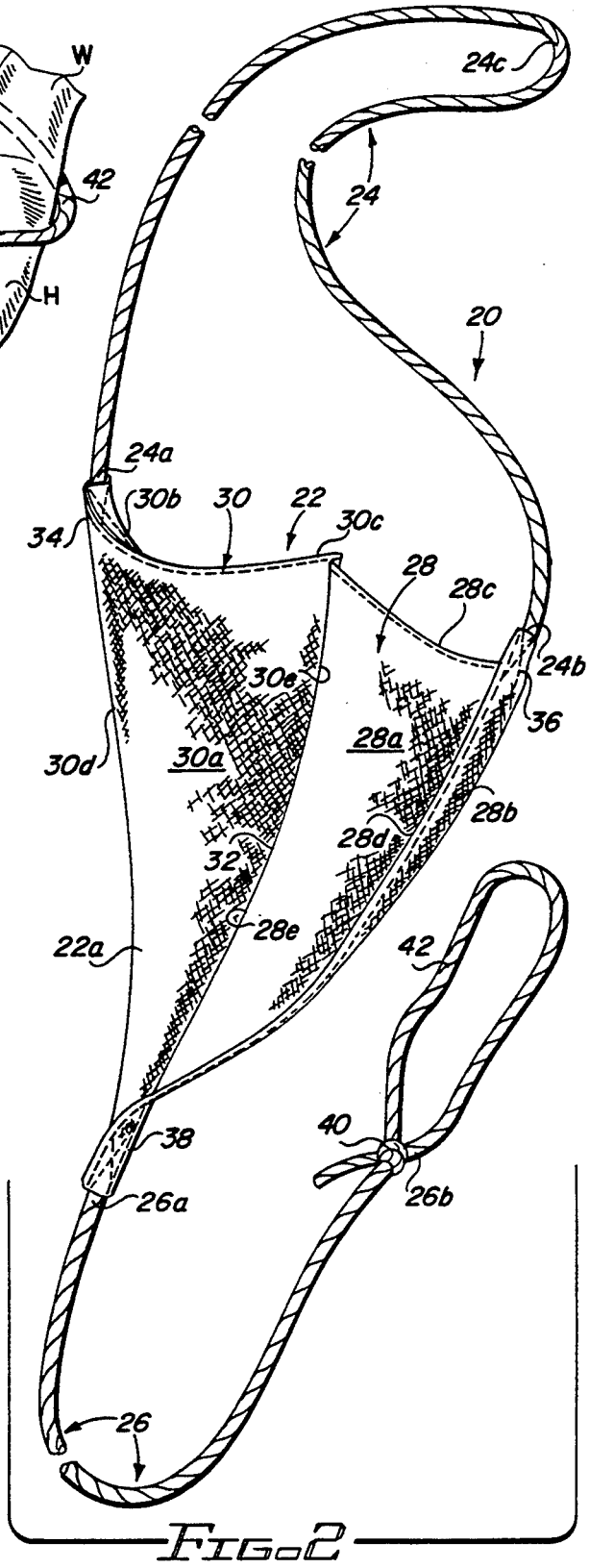
FIG. 2

WATER BALLOON TOSS SLING

BACKGROUND OF THE INVENTION

1. Field of the Invention

The present invention generally relates to projectile throwing slings and, more particularly, is concerned with a water balloon toss sling.

2. Description of the Prior Art

Historically, the use of a sling type of apparatus for launching a variety of projectiles dates back at least as far as the Biblical time of David and Goliath. In more recent times, various types of sling devices have been designed for use with such projectiles as bowling balls, shot puts, rubber balls, water balloons and the like.

Representative examples of these devices are disclosed in U.S. patents to Adams (U.S. Pat No. 1,199,330), Miles (U.S. Pat. No. 1,419,682), Isbell (U.S. Pat. No. 1,776,435), Simko (U.S. Pat. No. 2,644,441), Polly Jr. (U.S. Pat. No. 4,131,102), Brown (U.S. Pat. No. 4,232,648), Randoll (U.S. Pat. No. 4,240,396), Leehan (U.S. Pat. No. 4,305,584), Erlandson et al (U.S. Pat. No. 4,909,518), Ford (U.S. Pat No. 4,922,884) and Hull et al (U.S. Pat. No. 5,190,021).

The Adams and Leehan devices are designed for use with bowling balls, while the Miles device is to be used with shot puts. The Isbell, Simko, Polly Jr. and Brown devices all relate to throwing projectiles such as sports balls. The Randoll, Erlandson et al, Ford and Hull et al devices are all designed for launching water balloons through use of a variety of projecting means. The Randoll and Erlandson et al devices are particularly for use by more than one person. Each of the four balloon-launching devices is rather complicated in construction and thus fairly costly to manufacture. Additionally, due to such complexity, each of these devices is generally designed for use by a person of adolescent or older years. Moreover, given the somewhat rowdy nature of play generally to be expected when such devices are used, each of these devices appears prone to the likelihood of breakage or damage to the device.

Consequently, a need exists for a water balloon launching device of simple design and construction for inexpensive manufacture and less susceptiblity to damage and breakage and for use by persons of a wider range of ages.

SUMMARY OF THE INVENTION

The present invention provides a water balloon toss sling designed to satisfy the aforementioned need by avoiding the drawbacks of the prior art without introducing other drawbacks. Instead, the water balloon toss sling of the present invention provides expanded capabilities not available in the prior art devices.

One capability is the simplicity in design and construction of the water balloon toss sling for inexpensive manufacture and for ease in use by children from approximately the age of eight years on up to adults. Another capability is that the water balloon toss sling can be so constructed with such type of materials as to be capable of withstanding the wear and tear accruing from the rowdiness of play involved with the use of such types of launching devices.

Accordingly, the present invention is directed to a water balloon toss sling which comprises: (a) a substantially triangular-shaped pocket or pouch being of a shallow cup-like configuration adapted for seating a water-filled balloon; (b) a first length of cord being attached at a pair of opposite ends along one side of the pouch and being adapted for placement over outwardly extending fingers of a person's hand; and (c) a second length of cord being attached at one end to an opposite end of the pouch and being formed into a loop at the opposite end of the cord for encircling a portion of the hand, such as a wrist, of a person, such that the pocket is thereby suspendable below the person's hand, permitting rotational movement thereof for tossing a water balloon therefrom.

The triangular-shaped, cup-like configuration of the pouch is defined by a pair of three-sided, kidney-shaped pieces of material being joined together along a respective one side edge of each piece so as to form a pair of substantially equal, bilateral portions of the pouch, circumscribed by three side edges thereof. The three side edges extend and form a pair of spaced first and second corners of the pouch and a third corner thereof being equidistantly spaced from the first and second corners.

The first length of cord is attached, such as by stitching, at its opposite ends to the first and second corners of the pouch. The second length of cord is attached, such as by stitching, at one end to the third corner of the pouch. The first length of cord is positioned at a center portion thereof over the outwardly extending fingers of the person's hand with the palm facing upwardly, while the loop formed in the second length of cord is positioned about the wrist such that the second cord then extends between the index and second fingers and downwardly, thereby suspending the pouch below the hand. A water balloon can be positioned so as to be seated in the pouch. The fingers grip the first length of cord and the toss sling is rotated by the hand about the person, permitting the build-up of centrifugal force by such rotational movement. When release and tossing of the water balloon is desired, the first length of cord is slipped away from the fingers, permitting the centrifugal force, having thereby accrued, to push and toss the water balloon outwardly through a distance from the person.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a front perspective view of the water balloon toss sling of the present invention being shown in its deployed position about a person's hand.

FIG. 2 is a top plan view of the water balloon toss sling being shown partly broken away.

DETAILED DESCRIPTION OF THE INVENTION

Referring to FIGS. 1 and 2 of the drawings, there is illustrated a water balloon toss sling of the present invention, being generally designated 20. In its basic components, the water balloon toss sling 20 includes a pocket or pouch 22 and first and second lengths of cord 24, 26 being attached thereto for placement over the fingers F and for encircling the wrist W of the hand H of a person. By such arrangement, the pouch 22 being adapted to seat a balloon B therein, is thereby suspendable from the hand H so as to permit rotational movement of the toss sling 20 about the person for releasing and tossing the water balloon B therefrom through a considerable distance.

Referring specifically to FIG. 2, the pouch 22 of the toss sling 20 has a pair of equal, bilateral portions 28, 30 being formed by a pair of three-sided, kidney-shaped pieces of material, preferably being substantially identical in size to one another and joined together, such as by stitching, along a respective one side edge of each piece, so as to define the pouch 22 with a substantially triangular-shaped, shallow, cup-like configuration.

The pouch 22 being so formed has opposed inner and outer surfaces 22*a*, 22*b* formed by inner and outer surfaces 28*a*, 28*b* and 30*a*, 30*b* of the kidney-shaped pieces or bilateral portions 28, 30. The pouch 22 also has three side edges formed by two of the three sides 28*c*, 28*d*, 28*e* and 30*c*, 30*d*, 30*e* of the kidney-shaped pieces or bilateral portions 28, 30. The third sides 28*e*, 30*e* of the portions 28, 30 are connected together to form a center seam 32 of the pouch 22. The three side edges of the pouch 22 define a pair of spaced first and second corners 34, 36 and a third corner 38, being equidistantly spaced from the spaced first and second corners 34, 36.

Referring further to FIGS. 1 and 2, the first length of cord 24 of the toss sling 20 is attached in any suitable manner, such as by stitching, at one end 24*a* to the first corner 34 of the pouch 22. The first length of cord 24 is further attached in any suitable manner, such as by stitching, at the opposite end 24*b* to the second corner 36 of the pouch 22. The first length of cord 24 is of sufficient length for placement of a center portion 24*c* thereof over the outwardly extending fingers F of the person's hand H such that the pouch 22 is thereby suspendable a certain distance below the hand H of the user.

The second length of cord 26 of the toss sling 20 is attached in any suitable manner, such as by stitching, at one end 26*a* to the third corner 38 of the pouch 22. The opposite end 26*b* of the second length of cord 26 is attached to an adjacent portion thereof, in any suitable manner, such as by tying a knot 40 therein so as to form a loop 42 of sufficient diameter for encircling the wrist W of the person's hand H. The second length of cord 26 is of sufficient length both for encircling the wrist W, as hereinbefore described, and for subsequently extending therefrom downwardly between the index and second fingers F, so as to suspend the pouch 22 a certain distance below the hand H.

The pouch 22 of the toss sling 20 is preferably made of a flexible resilient washable fabric, such as waterproof vinyl or polyester material. The first and second lengths of cord 24, 26 are preferably made of a flexible resilient washable material, such as woven nylon or polyester. Of course, the pouch 22 and cords 24, 26 can be made of other suitable materials.

Referring to FIG. 1, the water balloon toss sling 20 is utilized essentially in the following manner. The loop 42 formed in the second length of cord 26 is positioned for encircling the wrist W of the person's hand H. The second length of cord 26 is then extended therefrom downwardly between the index and second fingers F. The first length of cord 24 is then positioned at a center portion 24*c* thereof over the outwardly extended fingers F of the same hand H of the person, the hand H having the palm side facing upwardly. By such arrangement of the first and second lengths of cord 24, 26 over the fingers F and wrist W of the hand H as hereinbefore described, the pouch 22 of the toss sling 20 is thereby suspended below the hand H. water-filled balloon B may then be seated within the cup-like configuration of the pouch 22 so as to contact the inner surface 22*a* of the pocket 22. The toss sling 20, being so deployed about the hand H as hereinbefore described, may then be swung by the hand H with a rotational motion about the person's hand H. The actual toss of the water balloon B from the toss sling 20 is effectuated by the fingers F releasing the first length of cord 24 such that the first length of cord 24 is permitted to slip outwardly away from the fingers F. The water balloon B is then pulled outwardly away from the toss sling 20 by the centrifugal force having been built up by the rotational motion of the toss sling 20 about the person's hand H.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. A water balloon toss sling, comprising:

(a) a pouch of flexible material adapted to seat a balloon filled with water, said pouch having a shallow cup-like configuration being of substantially triangular shape and three side edges being connected with one another so as to define a pair of spaced first and second corners and a third corner being spaced from said spaced first and second corners;

(b) a first length of flexible cord for placing over the fingers of a person's hand, said first length of flexible cord having a pair of opposite ends attached respectively to said first and second corners of said pouch; and (c) a second length of flexible cord having a pair of opposite ends, one of said pair of opposite ends of said second length of cord being attached to said third corner of said pouch and the other of said pair of opposite ends of said second length of cord being formed into a loop of sufficient diameter for encircling a portion of the person's hand and wrist such that said pouch is thereby suspendable from the person's hand by said first and second lengths of flexible cord for rotational movement thereof about the person's hand so that the water-filled balloon seated therein is releasable and tossable therefrom for traveling a distance from the person.

2. The sling of claim 1 wherein said pouch is formed by a pair of three-sided, kidney-shaped pieces of fabric, being substantially identical to one another, and being joined together along a respective one side edge of each piece, thereby defining said shallow, cup-like configuration being of substantially triangular shape.

3. The sling of claim 1 wherein said pouch has a pair of substantially identical bilateral portions.

4. The sling of claim 1 wherein said third corner is substantially equidistantly spaced from said spaced first and second corners.

5. The sling of claim 1 wherein said pouch has a pair of opposed inner and outer surfaces.

6. The sling of claim 1 wherein said pouch is made of a flexible resilient washable material.

7. The sling of claim 1 wherein said first length of cord has a center portion for positioning over the outwardly extending fingers of the person's hand with the palm facing upwardly.

8. A water balloon toss sling, comprising:

(a) a pouch having a pair of identical, bilateral portions being formed by a pair of three-sided, kidney-shaped pieces of fabric identical in size to one another and joined together by stitching along a respective one side edge of each piece so as to define a shallow, cup-like configuration and a substantially triangular shape of said pouch such that said pouch has opposed inner and outer surfaces and extends between three side edges being connected with one another so as to define a pair of spaced first and second corners of said pouch and a third corner thereof being equidistant from said spaced first and second corners, for seating a balloon filled with water;

(b) a first length of flexible cord extending between a pair of opposite ends, being attached at one of said opposite ends by stitching to said first corner of said pouch and being attached at the other of said opposite ends by stitching to said second corner of said pouch and further being of sufficient length for placement of a center portion of said first length of cord over the extended fingers of a person such that said pouch is suspendable from the fingers a suitable distance for permitting rotational movement thereof relative to the person for tossing a water balloon seated in said pouch an extended distance from the person; and (c) a second length of flexible cord extending between a pair of opposite ends, being attached by stitching at one of said opposite ends to said third corner of said pouch and having a loop formed at the other of said opposite ends by attaching to an adjacent portion of said second length of cord such that the loop formed is of sufficient diameter to encircle a person's wrist.

* * * * *